US006543193B2

(12) United States Patent
Houseal

(10) Patent No.: US 6,543,193 B2
(45) Date of Patent: Apr. 8, 2003

(54) SUPPORTS FOR LOG STRUCTURES, INCLUDING VERTICAL SUPPORT ELEMENTS ACTING ON STACKED LOGS AND HORIZONTAL SUPPORT ELEMENTS SELECTIVELY ENGAGING THE VERTICAL SUPPORT ELEMENTS

(76) Inventor: Barry L. Houseal, 10 Del Azul, Irvine, CA (US) 92614

( * ) Notice: Subject to any disclaimer, the term of this patent is extended or adjusted under 35 U.S.C. 154(b) by 0 days.

(21) Appl. No.: 09/902,190

(22) Filed: Jul. 10, 2001

(65) Prior Publication Data

US 2002/0046519 A1 Apr. 25, 2002

Related U.S. Application Data

(63) Continuation of application No. 09/289,534, filed on Apr. 9, 1999, now Pat. No. 6,266,934.

(51) Int. Cl.[7] ..... E04B 1/10
(52) U.S. Cl. ..... 52/233; 52/285.1; 52/698
(58) Field of Search ..... 52/233, 301, 1, 52/730.7, 284, 285.1, 585.1, 698, 699, 700

(56) References Cited

U.S. PATENT DOCUMENTS

| | | | | |
|---|---|---|---|---|
| 406,679 A | | 7/1889 | Wallenbeck | 52/301 |
| 1,813,455 A | | 7/1931 | Lawton | 52/233 |
| 1,942,348 A | | 1/1934 | Ward | 52/233 |
| 1,943,033 A | | 1/1934 | Midby | 52/233 |
| 3,189,950 A | | 6/1965 | Johnson | 52/233 |
| 3,420,013 A | | 1/1969 | Alvarado | 52/161 |
| 4,047,350 A | | 9/1977 | Chisum | 52/593 |
| 4,503,648 A | | 3/1985 | Mahaffey | 52/227 |
| 4,903,447 A | | 2/1990 | McDade | 52/233 |
| 4,909,012 A | | 3/1990 | Thompson, Jr. et al. | 52/741 |
| 5,040,351 A | | 8/1991 | Cornwall | 52/741 |
| 5,163,259 A | | 11/1992 | Hunsaker et al. | 52/233 |
| 5,277,008 A | | 1/1994 | Saulez | 52/233 |
| 5,400,845 A | | 3/1995 | Choiniere et al. | 144/353 |
| 5,567,089 A | | 10/1996 | Akamine | 405/285 |
| 5,687,520 A | | 11/1997 | Stranahan | 52/233 |
| 5,787,675 A | * | 8/1998 | Futagi | 52/745.1 |

* cited by examiner

*Primary Examiner*—Carl D. Friedman
*Assistant Examiner*—Naoko Slack
(74) *Attorney, Agent, or Firm*—Knobbe, Martens, Olson & Bear, LLP

(57) ABSTRACT

The walls of a wooden log building are provided with vertical support columns acting upon horizontal logs within the walls. The support columns prevent the logs, or groups of logs, from moving downward due to log shrinkage. Each support column comprises a vertical stack of log supports. Each support comprises an elongated support element, such as a pipe, and a plate element removably secured to an end of the support element. The plate elements support bottom surfaces of the logs and substantially prevent such bottom surfaces from moving downward. The weight of the building is concentrated within the support columns.

19 Claims, 8 Drawing Sheets

SUPPORTS FOR LOG STRUCTURES, INCLUDING VERTICAL SUPPORT ELEMENTS ACTING ON STACKED LOGS AND HORIZONTAL SUPPORT ELEMENTS SELECTIVELY ENGAGING THE VERTICAL SUPPORT ELEMENTS

This application is a continuation of allowed application Ser. No. 09/289,534, filed Apr. 9, 1999, now U.S. Pat. No. 6,266,934.

BACKGROUND OF THE INVENTION

1. Field of the Invention

This invention relates generally to log structures and, in particular, to load-bearing columns within log walls for supporting logs, joists, rafters, purlins, columns, and ridges bearing upon log walls.

2. Description of the Related Art

It is known that wooden logs shrink over time, due to the loss of water. Logs generally shrink more in their width than in their length. The amount, rate, and duration of shrinkage depend upon the level of humidity in the environment. Overall, logs shrink more in dry weather than they do in humid weather. This is because, in dry weather, the logs lose more of their water before reaching an equilibrium point with the environment. Logs also shrink faster in dry weather than in humid weather. In a drier environment, for example, a log having a diameter of about 8–15 inches can shrink as much as ¾ of an inch in one year. The shrinkage rate tends to be greater in the first year and generally tapers down thereafter. Conversely, the duration of log shrinkage is generally greater in more humid environments. Logs typically shrink for a duration of about somewhat less than a year to as long as four years.

Log shrinkage causes a variety of problems in log buildings, such as log homes. Typically, these buildings have walls that comprise stacks of horizontal wooden logs ("log wall stacks"). Over time, the logs in log wall stacks tend to move downward, due to the shrinkage of all of the logs. For example, if each of the logs in a 12 log wall shrinks one inch in width, then the height of the entire wall will decrease by one foot. Each log will move downward a distance equal to the total shrinkage of each of the logs below. Such downward motion can cause damage to internal structures within the walls, such as doors and windows. Often, doors and windows collapse under the weight of downward moving logs above.

For example, a log wall stack may contain a window frame enclosing a glass window. The window frame may comprise a vertical log on each side of the window. The window and frame will not shrink much at all in height over time. As the wall moves downward, due to shrinkage, the log directly above the window frame begins to bear against the frame. As the horizontal logs on each side of the window frame shrink further, the window and frame are compressed due to the weight of the logs above. Such weight can cause the frame and window to collapse.

Methods employed to deal with this problem are burdensome, inconvenient, and expensive. One approach has been to build log homes with wall cavities provided directly above structures within the log walls, such as doors and windows. As the logs shrink over time, the logs above can gradually move downward and occupy such cavities without damaging the internal wall structures. However, this may only delay the damage, since the logs might eventually move downward sufficiently to bear against the internal structures anyway. Also, the delay can be increased only by increasing the height of the wall cavities above the internal structures, which reduces the building integrity. Further, the wall cavities are normally covered with some type of panel or facade, which may be aesthetically displeasing.

Another problem caused by the downward movement of horizontal logs is that it upsets the positional relationship between the horizontal logs and the vertical logs in the wall. Vertical logs are commonly used to build the frame of the house. Vertical logs often serve as columns to support the roof of the building and to transfer the weight of the roof to a fixed base. Also, internal wall structures often include vertical logs. For instance, a door frame or window frame may include vertical logs on its sides. Since wooden logs do not shrink significantly in their lengthwise direction, the vertical logs do not decrease much in height. Thus, log shrinkage upsets the positional relationship between horizontal and wooden logs.

A known method of dealing with this problem is to provide a short threaded rod, known as a screw jack, at the bottom end of each of the vertical logs. The threaded rod is fixed with respect to the foundation of the building. The vertical log has a short vertical channel which slidably receives the threaded rod so that the log can be slightly raised or lowered while maintaining a sliding engagement between the log and the threaded rod. The log rests upon a nut threadingly engaged with the rod. The nut bears the weight of the log as well as part of the weight of the rest of the building. The nut can be rotated so that the nut and log move vertically along the threaded rod. In this manner, the vertical log can be raised or lowered, relative to the fixed foundation of the building. Over time, as the horizontal logs descend due to log shrinkage, upsetting the positional relationship between the horizontal and vertical logs, the vertical logs are lowered to compensate for the downward movement of the horizontal logs.

Unfortunately, this method is very difficult, time-consuming, and expensive. The amount of downward displacement of the horizontal logs can vary throughout the structure, and must be measured throughout the walls. Thus, each of the vertical logs may have to be lowered by different amounts, complicating the procedure. Also, the procedure, i.e., the lowering of the vertical columns, must be repeated periodically. It is normally repeated once or twice a year. This further increases the cost and time consumption of this method. Further, the lowering of vertical logs can cause the roof to become uneven, which reduces the building integrity.

The above-described methods of dealing with the problems associated with log shrinkage merely compensate for or prevent damage that may result from the downward movement of logs in a log wall stack. Thus, there is a need for a method of preventing the downward movement of logs due to log shrinkage.

SUMMARY

Accordingly, it is a principle object and advantage of the present invention to overcome the above-mentioned limitations and to provide an improved log building.

In accordance with one embodiment, the present invention provides a log wall comprising a stack of generally horizontally positioned wooden logs on a fixed support surface (e.g., the foundation of a log cabin) and one or more generally vertical support columns acting upon the stack of logs. Each column comprises a stack of generally vertical log supports, the stack of log supports also extending from the fixed surface. Each of the log supports vertically extends for the width of one or more logs within the stack of logs, so that a top end of the log support is generally aligned with the top surface of a horizontal log, and so that a bottom end of the log support is generally aligned with the bottom surface of a horizontal log. Each log support may extend for the width of one log or the width of a plurality of logs. Each set of one or more logs across the width of which a single log support extends will be referred to herein as a "set" or "sub-stack" of logs. Further, an "initial position range" of each sub-stack of logs is defined as the space between the initial location of the top surface of the top log of the sub-stack and the initial location of the bottom surface of the bottom log of the sub-stack, immediately after the log wall is built. Advantageously, the vertical support columns, each comprised of a plurality of log supports, maintain each sub-stack within its initial position range, thus avoiding the above-described problems associated with the downward movement of logs due to log shrinkage.

In a preferred embodiment of the present invention, the log supports within the above-described support columns may be configured to extend through only a single log. An "initial position range" of each log is defined as the space between an initial location of the top surface of the log and an initial location of the bottom surface of the log. In this configuration, the support columns advantageously maintain each log within its initial position range.

In another preferred embodiment of the present invention, the log supports of the above-described support columns each comprise a generally vertical support element, such as a rod or cylinder, and a plate element positioned on one end of the support element. Each plate element is advantageously adapted to support the bottom surface of a first log of a sub-stack, to prevent the bottom surfaces of the first logs of the sub-stacks from moving downward.

In accordance with another preferred embodiment of the present invention, each plate element comprises a generally flat plate and a rod attached to a flat side of the plate. Also, each of the support elements of the supports comprises an elongated cylinder. The end of the rod opposite the plate is adapted to be slidably and removably inserted into an end of the cylinder.

For purposes of summarizing the invention and the advantages achieved over the prior art, certain objects and advantages of the invention have been described herein above. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1B:
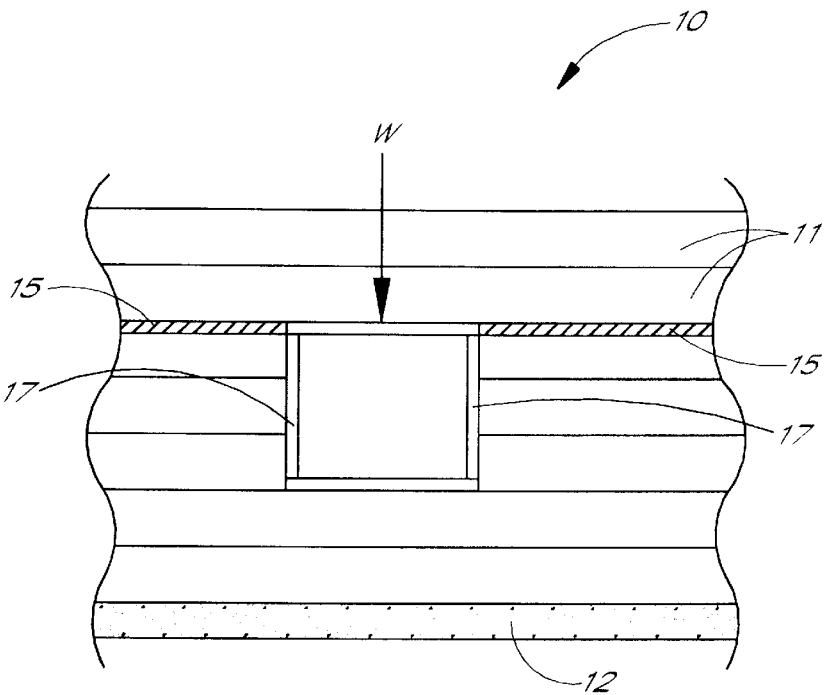
FIG. 1B (PRIOR ART)
FIG. 1B is a front view of the log wall stack of FIG. 1A after the logs have shrunk somewhat.
Figure 1A:
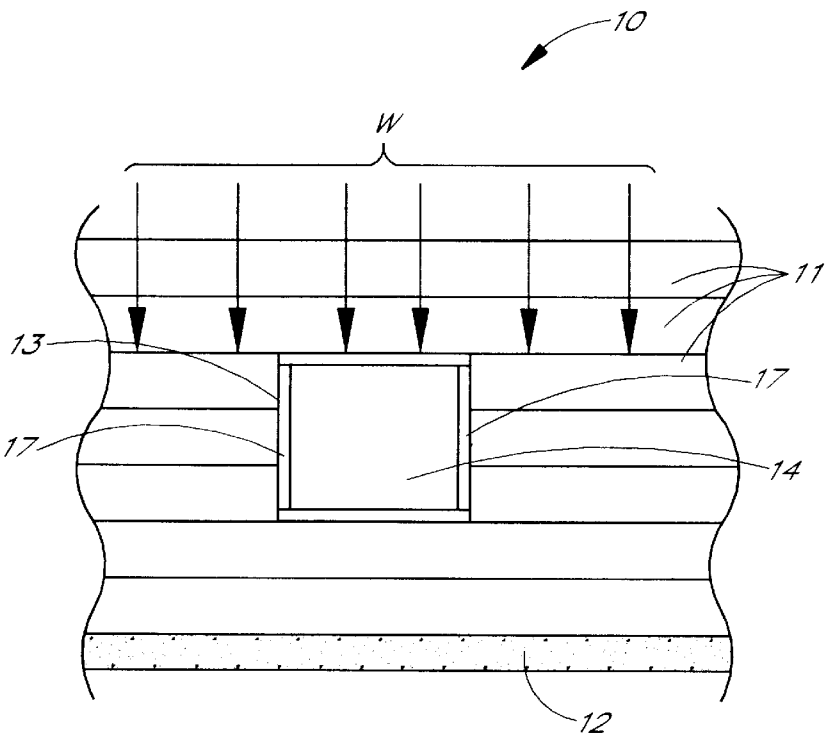
FIG. 1A (PRIOR ART)
FIG. 1A is a front view of a conventional log wall stack immediately after being built.

As mentioned above, the shrinkage of logs in conventional log walls normally causes damage to internal wall structures such as doors and windows. FIGS. 1A and 1B illustrate this phenomenon. FIG. 1A shows a conventional log wall 10 including logs 11 stacked horizontally upon a foundation 12, a window frame 13, and a glass window 14 enclosed within the frame 13. The logs on each side of the window frame 13 support the weight W of the logs above. Over time, all of the logs 11 shrink in their widthwise direction, i.e., in their diameter. In contrast, the window frame 13 does not significantly shrink, since the vertical wooden members 17 (which may also be logs) forming the sides thereof do not shrink significantly along their length. The glass window 14 also does not shrink. As the logs 11 shrink, those logs on the sides of the frame 13 gradually descend and support less of the weight W of the logs above. Simultaneously, the frame 13 and window 14 undesirably support more of the weight W of the logs above, which may cause the frame 13 and window 14 to collapse. As log shrinkage continues, gaps 15 may form between the log directly above the window frame 13 and the logs directly below that log, as shown in FIG. 1B. At this point, the frame 13 and window 14 undesirably support the entire weight W. Eventually, the window and frame will probably collapse under such weight.

Figure 2:
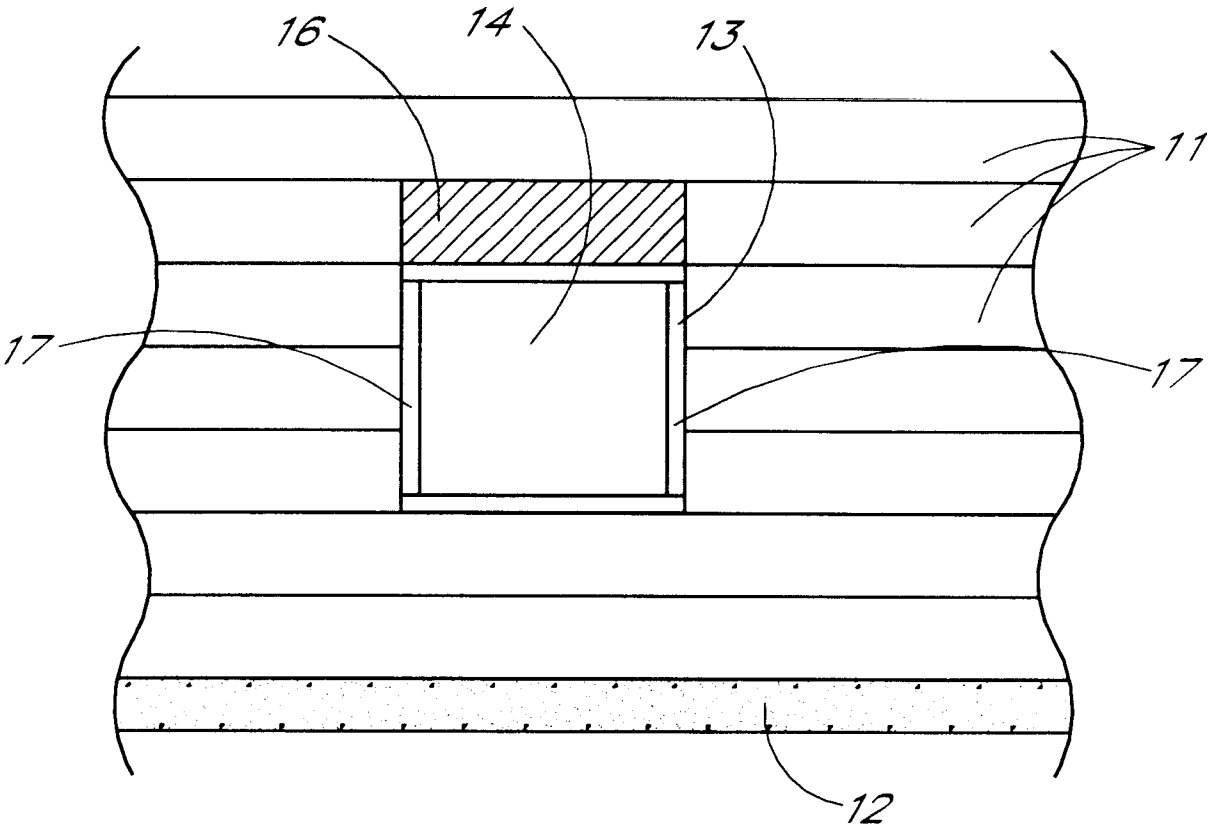
FIG. 2 (PRIOR ART)
FIG. 2 is a front view of a conventional log wall stack, illustrating a prior art method of delaying or preventing the collapse of internal wall structures due to log shrinkage.

FIG. 2 shows a prior art method of dealing with the above-described problems associated with log shrinkage. According to this method, wall cavities are provided directly above all of the internal structures within the log walls. For instance, in FIG. 2, a wall cavity 16 is provided above the window frame 13 and window 14. As the logs 11 shrink over time, the logs directly above the frame 13 slowly occupy the cavity 16. During this period, the frame 13 and window 14 do not support any of the weight of the logs above. Unfortunately, this method sometimes merely delays, instead of prevents, the collapse of the frame and window. Eventually, the logs above might move downward until they bear against the frame 13. This may ultimately result in the collapse of the frame and window due to the weight of the logs above. Additionally, the need to include the cavity 16 in the architectural plans significantly affects the appearance of the log structure.

Figure 3:
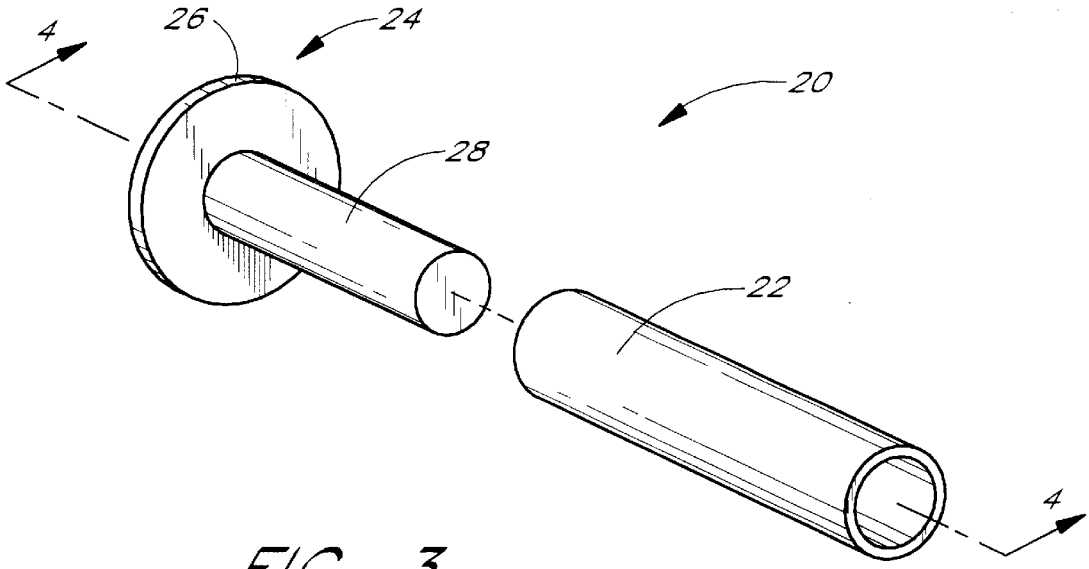
FIG. 3 is a perspective view of a weight-bearing log support having features and advantages in accordance with the teachings of the present invention.
Figure 4:
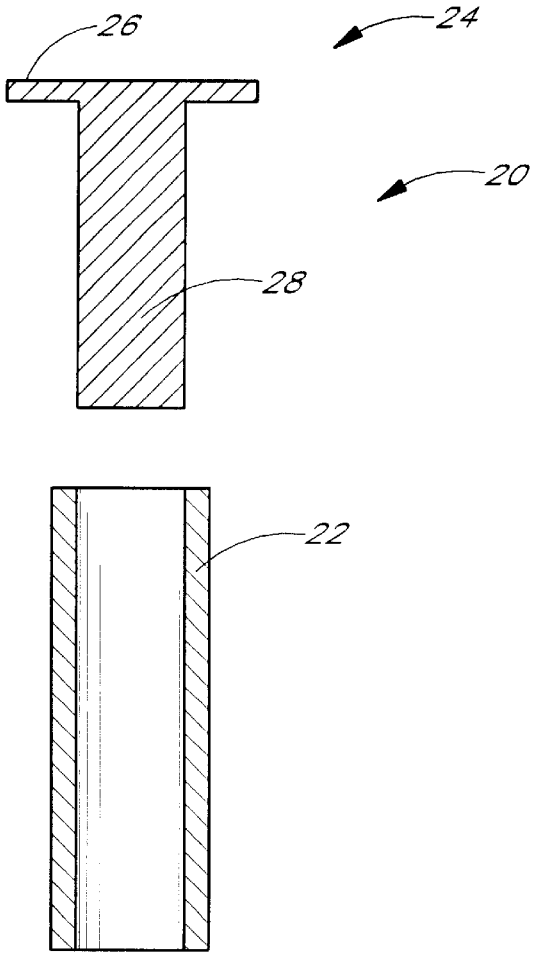
FIG. 4 is a side cross-sectional view of the log support of FIG. 1.

FIGS. 3 and 4 show a weight-bearing log support 20 made in accordance with the present invention, for substantially preventing the downward movement of logs in a log wall stack. The support 20 comprises an elongated support element 22 and a plate element 24. The support element 22 preferably has a length about equal to the width of a wooden log. The support element 22 can have any one of many different cross-sections, keeping in mind the goals of being adapted to be stacked or adjacent to a log wall stack, as described in greater detail herein, and supporting the weight of a log building. A tubular or solid cylindrical cross-section is suitable for these goals. The plate element 24 is positioned on one end of the support element 22. The plate element 24 can be fixed to the support element 22 by, for example, welding the plate element thereto. Alternatively, the plate element 24 can be removably engaged with the support element 22. The plate element 24 has a generally flat surface adapted to support a bottom surface of a horizontally positioned wooden log in a log wall stack.

In one preferred configuration, shown in FIGS. 3 and 4, the support element 22 comprises a cylindrical pipe, and the plate element 24 comprises a generally disk-shaped plate 26 and an alignment rod 28 attached at about the center of a flat side of the plate 26. The rod 28 is adapted to be slidably and removably received within the pipe 22, providing a relatively tight fit therebetween. Alternatively, a solid cylindrical rod could be used as the support element 22, with the plate element 24 comprising a plate 26 welded to an end thereof. An advantage of using a solid rod as the support element 22 is that a smaller diameter can be used to provide the same strength. However, using a pipe as the support element allows the log building to be more easily manufactured, as described in greater detail herein. This is because the use of a pipe does not require the plate element to be welded thereto. Instead, the plate element can simply be slidably inserted into the pipe as the log wall stack is being formed.

Wooden logs can be formed from various species of wood, such as Douglas-Fir, Lodgepole Pine, or Engelmann Spruce, and typically weight between 15 and 50 lbs. The supports 20 preferably have sufficient compression strength to support the weight of the roof and walls of a log building. When vertically oriented in isolation, i.e., outside of a log, each support 20 can preferably support a vertical load as high as 3,000 to 10,000 lbs. However, when positioned inside of a vertical channel within a wooden log, the support 20 receives lateral support from the log and can support much higher loads. Inside of a log, each support 20 can preferably support a vertical load as high as 30,000 lbs.

In the configuration of FIGS. 3 and 4, the support elements 22, plates 26, and rods 28 may be formed from any of a variety of materials, keeping in mind the goal of supporting the weight of the roof and walls of a log building. A suitable material is steel. Preferred dimensional ranges for the supports 20 are as follows: The thickness of the pipe forming the support element 22 is preferably about ⅛ inch or greater. The outside diameter of the pipe is preferably within the range of about ¾ inch to 2 inches. The plate 26 diameter is preferably within the range of about 1¼ inches to 4 inches. The plate 26 thickness is preferably within the range of about ⅛ inch to ½ inch. More preferably, the steel pipe forming the support element 22 is a "strong pipe" or "extra strong pipe," as defined by the AISC (American Institute of Steel Construction) Handbook. Even more preferably, the support element 22 is formed from a 1⁵⁄₁₆ inch outside diameter "Schedule 80" (as defined by the AISC Handbook) steel pipe, the plate 26 has a thickness of about ¼ inch and a diameter of about 2½ inches, and the rod 28 is about 3 inches long. The rod 28 may be attached to the plate 26 by any of a variety of means, giving due consideration to the goals of strength of attachment and resistance to shear stress. A suitable means for attaching the rod 28 is to weld it onto the plate 26. In a preferred embodiment, the plate element 24 advantageously comprises a large steel washer, which forms the plate 26, that is welded to an end of a steel rod 28.

Figure 5:
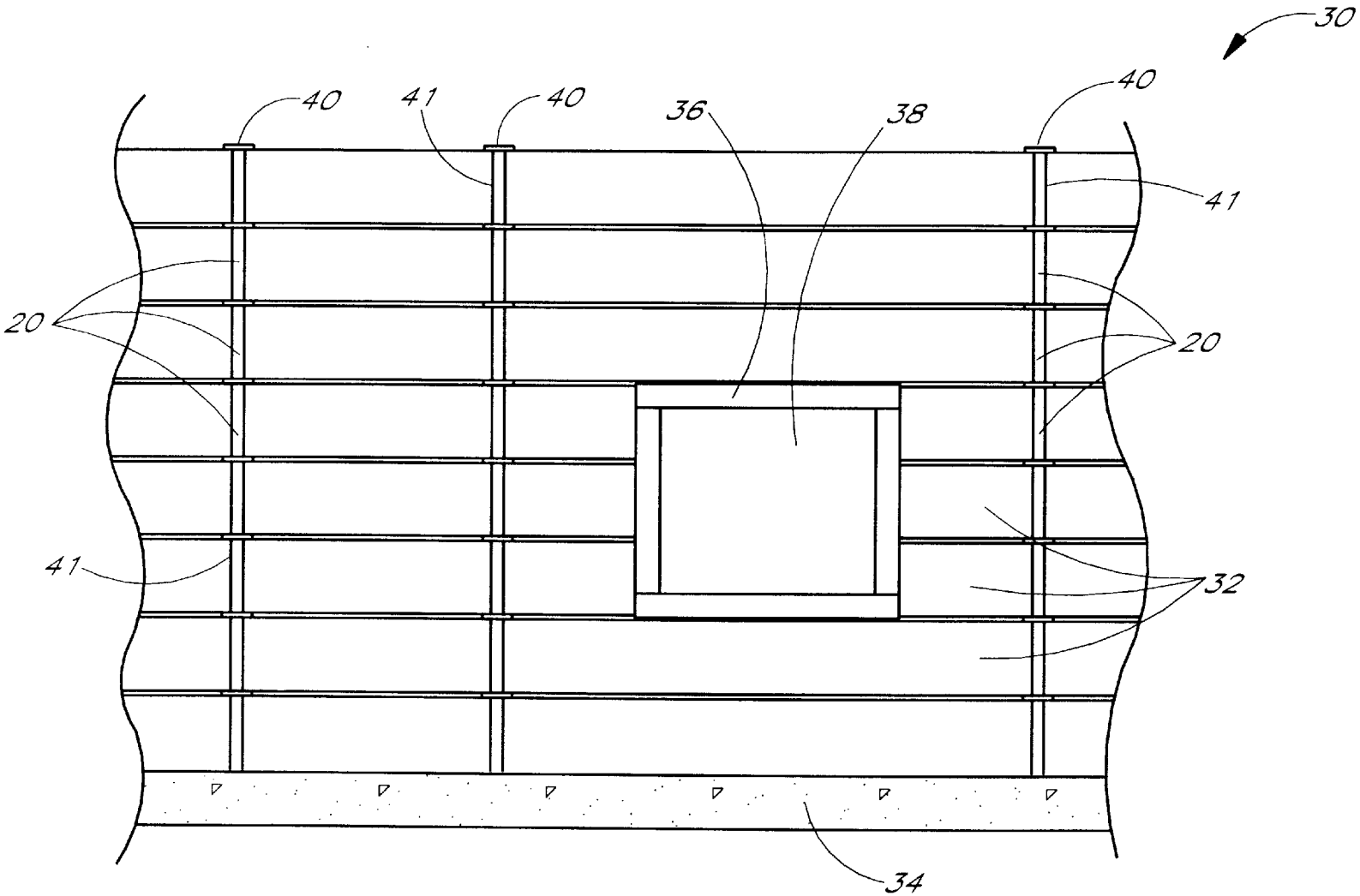
FIG. 5 is a front cross-sectional view of a log wall stack including support columns having features and advantages in accordance with the teachings of the present invention.

A plurality of supports 20 may be vertically stacked to substantially prevent the downward movement of logs in a log wall stack and the consequent damage that is caused to internal wall structures. FIG. 5 shows a log wall 30 configured in accordance with the present invention. The wall 30 comprises a stack of generally horizontal logs 32 on a foundation 34 and, for purposes of illustration, a window frame 36 and a window 38 enclosed therein. Also provided are a plurality of vertical support columns 40 which act upon the logs in the log wall stack. The columns 40 support substantially all of the weight of the roof and the logs of the building. The columns 40 transfer such weight downward to the fixed foundation 34, which is preferably formed from a strong material, such as concrete.

The columns 40 are each provided in a plane parallel to or coplanar with a vertical plane through the center of the log wall 30. Preferably, the columns 40 are provided within vertical channels 41 formed in the wall. The channels 41 may be in the center of the log wall, in which the columns 40 advantageously provide more balanced support within the wall. Alternatively, the channels 41 may be within the wall 30 yet somewhat offset from the center of the wall. In this construction, the columns 40 may provide improved support structures above the wall, such as roof rafters, joists, purlins, etc. In an alternative embodiment, the columns 40 may be provided adjacent to the wall 30 and may include transverse support members providing support to the logs 32. Yet another alternative is to provide pairs of vertical columns. In this embodiment, the columns of each column pair may be provided within the wall or adjacent to the logs of the wall. Also, the columns of each column pair may be provided on opposite sides of the center of the wall or both on one side of the center of the wall.

Each of the support columns 40 preferably comprises a plurality of vertically stacked supports 20 each extending across only a single log 32. Each support 20 preferably comprises a plate element 24 positioned on an upper or lower end of a support element 22. Advantageously, the plate elements 24 are positioned on the upper ends of the support elements 22. This permits the log wall to be manufactured more easily, as described in greater detail below. Alternatively, the plates could be positioned on the lower ends of the support elements 22, which would provide the same structural advantages. The vertical channels 41, which extend through the width of the logs 32, are sufficiently wide to slidably receive the support elements 22 of the supports 20. The plates 26 of the plate elements 24 are interposed between the logs 32 so that the logs rest against the flat surfaces of the plates 26. The vertical channels 41 are preferably less wide than the plates 26, so that the logs 32 can rest on the plates 26. Moreover, the vertical channels are preferably only slightly wider than the support elements 22. This maximizes the surface area of contact between the logs 32 and the plates 26, so that the weight is distributed more evenly within the plate 26. In addition, each support element 22 also rests upon the plate 26 of the support 20 directly below. Thus, each of the supports 20 provides support to both the log 32 and the support 20 resting above.

The log wall stack 30 of FIG. 5 advantageously prevents damage to internal wall structures due to log shrinkage. Over time, as the logs 32 shrink, the support columns 40 prevent the bottom surfaces of the logs from moving downward. The bottom surfaces rest against the plates 26 of the supports 20, which prevents the logs from descending. The plates 26 maintain the bottom surfaces of the logs in a generally fixed vertical position. Also, the vertical distance separating the bottom surfaces of each pair of adjacent logs is fixed over time. As a result, the logs directly above the internal wall structures, such as the window frame 36 and window 38 in FIG. 5, are prevented from moving downward and causing the collapse of the internal structures. Thus, there is no need to provide wall cavities above such structures, as in the prior art.

In order to provide more balanced and uniform support to the log building, the support columns 40 are preferably provided throughout the walls of the building. In a preferred configuration, the columns 40 are spaced about three to six feet apart throughout the walls. More preferably, the columns are spaced about four feet apart. However, wall structures such as windows and doors may be wider than four feet. To accommodate a wall structure between two columns 40, the columns can be separated as much as 15 feet. However, larger separations between the columns 40 are preferably avoided if possible, to provide more balanced support throughout the structure.

Figure 6A:
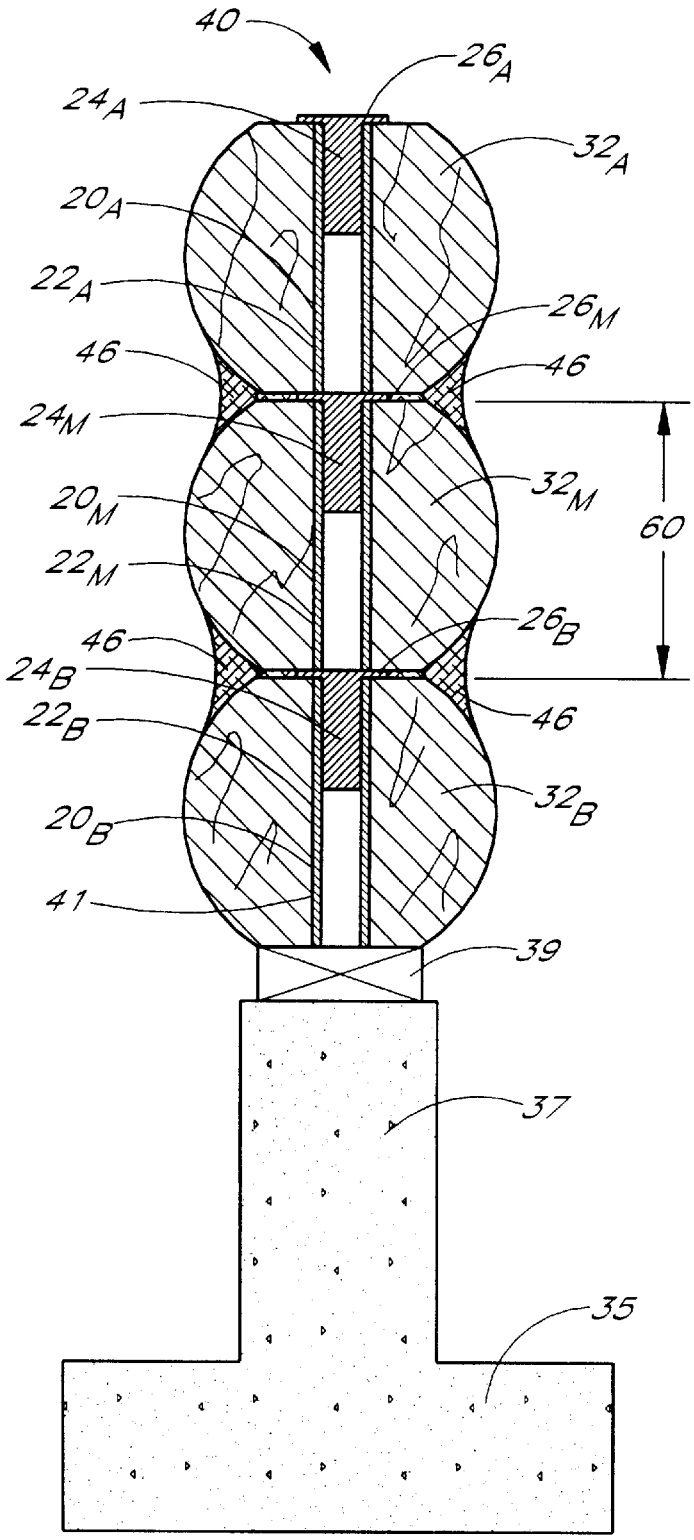
FIG. 6A is an exploded side cross-sectional view of a log wall stack as initially built, including a support column having features and advantages in accordance with the teachings of the present invention.
Figure 6B:
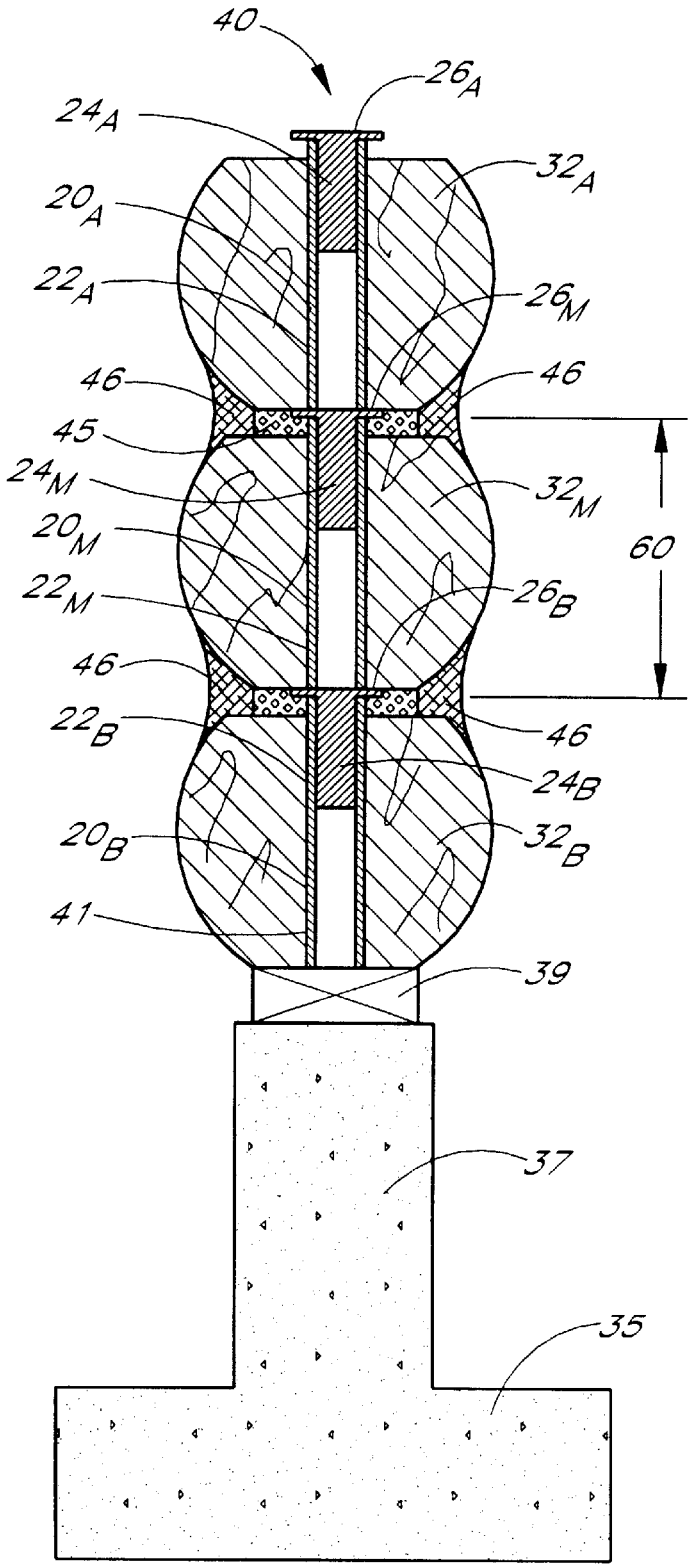
FIG. 6B is a side cross-sectional view of the log wall stack of FIG. 6A, after log shrinkage has begun.

FIGS. 6A and 6B show in greater detail the preferred configuration of the support columns 40 and also illustrate how the columns 40 prevent the downward movement of horizontal logs in a log wall stack. FIG. 6A shows a portion of a log wall stack as initially built, including a support column 40 in accordance with the present invention. The column 40 includes a vertical stack of supports as described above. In FIG. 6A, three logs are shown stacked upon a foundation comprising a concrete footing 35, a concrete stem wall 37, and a pressure treated wood sill plate 39. These logs preferably have generally flattened top and bottom surfaces to provide a larger surface area of contact therebetween. This provides improved weight distribution between the plates of the supports in the support column 40 and makes it easier to stack the logs during the construction of the log building. FIGS. 6A and 6B show a middle log $\mathbf{32}_M$ stacked between a log above, $\mathbf{32}_A$, and a log below, $\mathbf{32}_B$. The column 40 includes one support positioned within each log in the log wall. In the figures, the logs $\mathbf{32}_A$, $\mathbf{32}_M$, and $\mathbf{32}_B$ include corresponding supports $\mathbf{20}_A$, $\mathbf{20}_M$, and $\mathbf{20}_B$, respectively, which in turn comprise elongated support elements $\mathbf{22}_A$, $\mathbf{22}_M$, and $\mathbf{22}_B$ and plate elements $\mathbf{24}_A$, $\mathbf{24}_M$, and $\mathbf{24}_B$, respectively. Further, the plate elements include plates $\mathbf{26}_A$, $\mathbf{26}_M$, and $\mathbf{26}_B$, respectively. Each support is configured so that its elongated support element has a length equal to the vertical width of the log within which it is positioned. For simplicity, support $\mathbf{20}_M$ is described herein below. However, all of the supports are configured in a similar manner.

The support element $\mathbf{22}_M$ of support $\mathbf{20}_M$ is preferably positioned so that its lower and upper ends are horizontally aligned with the bottom and top surfaces, respectively, of log $\mathbf{32}_M$. The support element $\mathbf{22}_M$ and the log $\mathbf{32}_M$ rest upon the top surface of the plate $\mathbf{26}_B$ of the support $\mathbf{20}_B$. The plate element $\mathbf{24}_M$ is preferably fitted onto the upper end of the support element $\mathbf{22}_M$. However, those in the art will understand that the advantages of the present invention can also be obtained by inserting the plate elements into the lower ends of the support elements. In a preferred configuration, the plate $\mathbf{26}_M$ of the plate element $\mathbf{24}_M$ is advantageously positioned directly above and adjacent to the log $\mathbf{32}_M$. The plate $\mathbf{26}_M$ supports the bottom surfaces of the log $\mathbf{32}_A$ and the support element $\mathbf{22}_A$. Thus, adjacent logs are separated at least by the thickness of the plate therebetween. For example, the top surface of the log $\mathbf{32}_M$ is separated from the bottom surface of the log $\mathbf{32}_A$ at least by the thickness of the plate $\mathbf{26}_M$. Alternatively, the top surface of each log can be countersunk so that the top surface of the plate is horizontally aligned therewith. Due to irregularities in the shape of the logs as well as the interposition of the plates therebetween, gaps are formed between the logs. According to a known method, these gaps can be filled by providing styrofoam backer rod 45 between the logs after the logs have been stacked, and filling the crevices with an elastomeric chinking compound 46 with, for example, a caulking gun. The chinking compound 46 adheres to the logs. Many types of chinking compounds are known in the art. A suitable chinking compound for the purposes of this invention is Timbertite, sold by Schnee-Moorehead.

Each log in the log wall stack has an "initial position range," which is defined as the space between the initial location of the log's top surface and the initial location of the log's bottom surface, immediately after the log wall is built. For example, in FIG. 6A, the initial position range of log 32 is the space 60. In the preferred configuration, the initial position range of each log is the space between the top surface of the lower plate and the bottom surface of the above plate. For example, in FIG. 6A, the initial position range 60 of log 32 is the space between the top of plate $\mathbf{26}_B$ and the bottom of plate 26.

FIG. 6B shows the configuration of the log wall stack after the logs have shrunk over time. Due to shrinkage, the vertical width of each of the logs has decreased. As a result, the top surface of each of the logs has moved downward to a lower vertical position. However, each log has advantageously been maintained within its initial position range. This is because the supports of the support column 40 are positionally fixed. The bottom surface of each of the logs is prevented from moving down, due to the fixed position of the plates upon which they rest. For example, in FIG. 6B, the bottom surface of log $\mathbf{32}_M$ has been held in place by the fixed plate $\mathbf{26}_B$ of the support $\mathbf{20}_B$. In this configuration, the logs are prevented from moving downward and potentially damaging internal wall structures. Furthermore, although the gaps between adjacent logs will widen over time due to log shrinkage, the elastomeric material 46 stretches to continually fill these gaps.

A log wall stack having a support column 40 according to the present invention is preferably manufactured in the following manner. A first log is placed upon a fixed surface such as a foundation 34 or a concrete stem wall. Vertical channels within the log define the locations of the columns 40 within the log wall stack. Such vertical channels are preferably pre-drilled through the width of each of the logs by using, for example, wood auger drill bits. For each vertical channel, a cylindrical pipe having a length longer than the vertical width of the log is inserted into the channel. The lower end of the pipe is rested against a fixed surface directly below the log, such as the foundation or the top surface of a plate 26 of a support 20 within an adjacent lower log, so that the pipe extends above the top surface of the log. The upper end of the pipe is cut off at a location in a general horizontal alignment with the top surface of the log. The pipe thus forms a support element 22 within the vertical channel. A pre-formed plate element 24, comprising a plate 26 and an attached rod 28 as described above, is inserted into the upper end of the support element 22 to form a support 20. The plate 26 is positioned directly above and adjacent to the top surface of the log. A support 20 is formed in this manner for every vertical channel in the log.

This process is then repeated. Accordingly, a second log is then stacked above the first log. The second log rests upon the plates 26 positioned above the first log. The second log has pre-drilled vertical channels that are generally collinear with the vertical channels formed through the width of the first log. Pipes are then inserted into the channels so that their lower ends rest against the plates 26 above the first log. The pipes are cut as described above to form new support elements 22. Pre-formed plate elements 24 are inserted into the upper ends of the new support elements 22 to form new supports 20 within the second log. The process is then repeated successively for each new log in the log wall stack.

In an alternative process, the supports 20 of the support columns 40 are provided upside down, i.e., so that the plates 26 are at the lower ends of the support elements 22. According to this process, the supports 20 are positioned on top of a log in the log wall stack, so that the plates 26 rest on the log and the ends of the support elements 22 opposite the plate extend upward from the log. A next log having vertical channels in alignment with the position of the support columns 40 is then placed onto the above-mentioned log so that the support elements 22 are received within the channels. The top portions of the support elements are cut so that they have a length equal to the width of the log, as described above. New supports 20 are then positioned above the prior supports of the column 40, in an upside down orientation as described above. The process is then repeated for the next log in the log wall stack. The resulting structure provides all of the advantages of that described above. However, due to the considerable weight of the logs, it may be somewhat difficult to position each log onto the upside down supports 20.

In another alternative process, the logs 32 are all prefabricated to have identical dimensions, according to methods known in the art. Accordingly, the logs all have the same width. This allows the supports 20 to be prefabricated so that the support elements 22 each have a length equal to the width of the logs. The plate elements 24 can be welded onto the support elements 22 prior to beginning the construction of the building. Advantageously, the building can be constructed with less labor time and cost, since the pipes do not have to be custom-fitted as described above.

Figure 7:
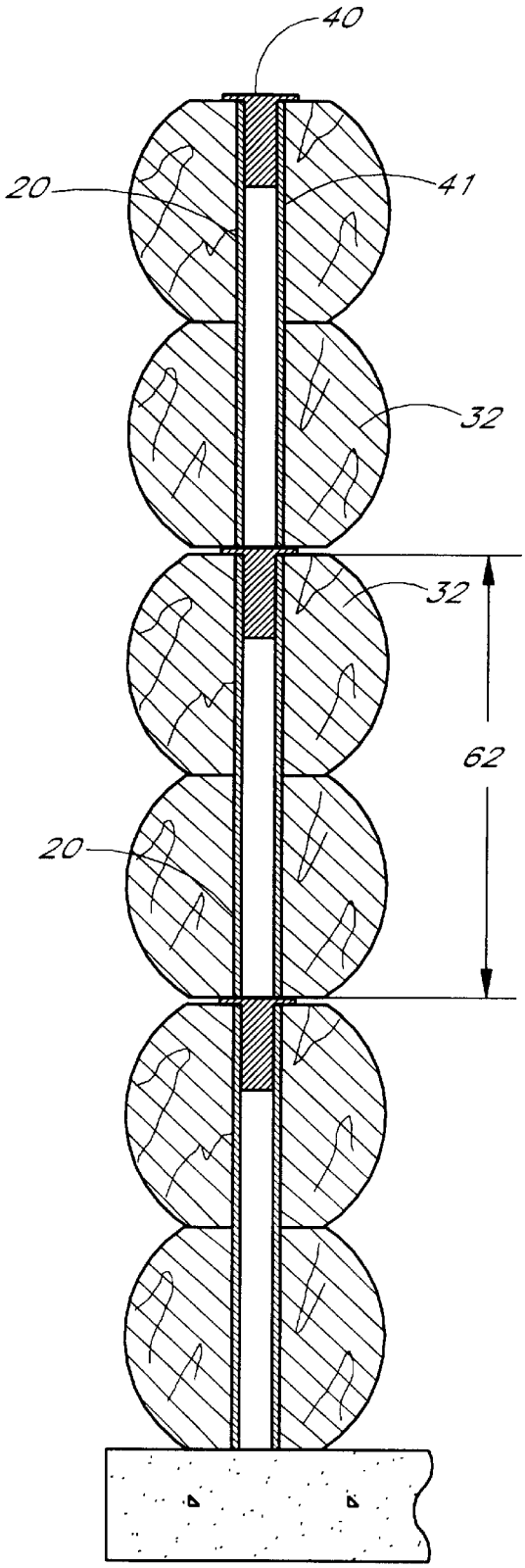
FIG. 7 is an exploded side cross-sectional view of a log wall stack including a support column according to an alternative embodiment of the present invention.

FIG. 7 shows an alternative configuration of a support column 40. In this configuration, the supports 20 extend through two logs 32. Each plate 26 supports the bottom surface of a stack of two logs. Those in the art will understand that the supports 20 can extend through any number of contiguous logs, i.e., a "sub-stack" of logs, without departing from the spirit and scope of the present invention. Furthermore, the support columns 40 can be configured to have supports 20 of various different lengths. For example, a support column 40 may have some supports 20 extending through single logs, some through two logs, and some through three logs. An advantage of using supports 20 that extend through multiple logs is that more logs can be stacked at a time, reducing labor time and costs. Another advantage is that less plate elements 24 are required, which reduces material costs. Despite these advantages, it is preferred to use a single support 20 within each log. This is because it is sometimes difficult to align the vertical channels 41 within multiple logs in order to insert the support elements 22 therein.

Figure 8:
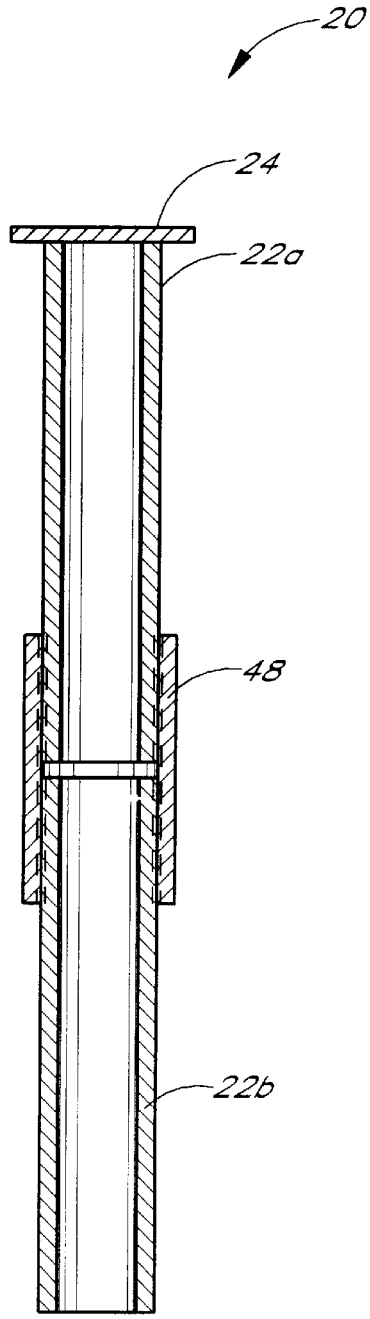
FIG. 8 is a side cross-sectional view of an alternative embodiment of a log wall support having features and advantages in accordance with the teachings of the present invention.

The supports 20 can be lengthened, as in FIG. 7, by providing a longer support element 22. In the preferred manufacturing method described above, a pipe can be inserted into a stack of logs before being cut to form the support element 22. Alternatively, as shown in FIG. 8, the support 20 can be lengthened by providing a threaded coupler between adjacent, vertically aligned support elements. Accordingly, a lower end of an upper support element 22*a* is externally threaded and received within an upper end of an internally threaded coupler 48. Similarly, an upper end of a lower support element 22*b* is externally threaded and received within a lower end of the coupler 48. The vertical channel within the log stack is preferably wider than the outside diameter of the coupler 48, so that the coupler will fit within the channel.

Alternatively, the coupler can be externally threaded and the support elements 22*a* and 22*b* internally threaded, which allows the coupler to be received within the support elements. Advantageously, the coupler permits the length of the support 20 to be modified if necessary, simply by rotating the support elements 22*a* and 22*b* within the coupler 48. Any number of support elements 22 can be connected together with couplers 48 as in FIG. 8. FIG. 8 also shows an alternative configuration of the plate element 24, in which the plate element comprises a plate welded onto one end of the support element.

Supports 20 that extend through contiguous groups of logs advantageously maintain the entire group within its initial position range. The initial position range of a contiguous group of logs, or "sub-stack," is defined as the space between the initial location of the top surface of the top log in the group and the initial location of the bottom surface of the bottom log in the group. For example, in FIG. 7, the initial position range of the intermediate pair of logs is the space 62. As the logs shrink, the intermediate pair of logs will remain within the space 62, due to the fixed position of the support 20 below. In this configuration, each individual log is not maintained within its own initial position range. This is because the shrinkage of the lower logs within the sub-stack lowers the position of the bottom surfaces of the upper logs in the sub-stack, so that the bottom surfaces of the upper logs drop below the initial position ranges of the upper logs.

Figure 9:
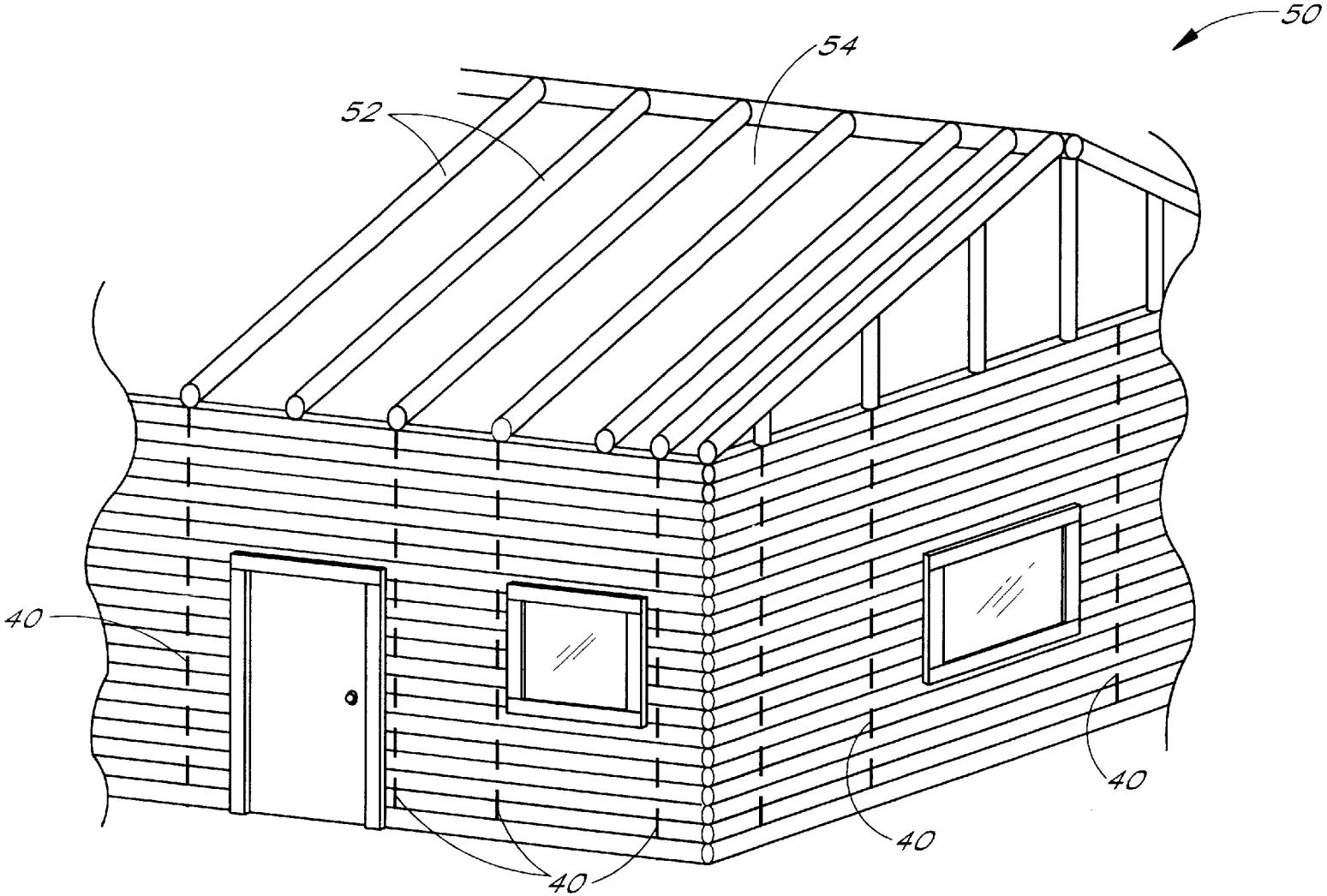
FIG. 9 is a perspective, partly sectional view of a log home including support columns having features and advantages in accordance with the teachings of the present invention.

In a log building, support columns 40 of the present invention can be provided to support a variety of structures within the building, such as logs, joists, rafters, purlins, columns, and ridges bearing upon the log walls. For example, FIG. 9 shows a log building 50 having a plurality of support columns 40 in accordance with the teachings of the present invention. The roof 54 of the log building 50 contains rafters 52, or joists, which may also be logs. The columns 40 are located underneath the rafters 52. This is because the weight of the roof 54 is concentrated within the portion of the log wall underneath the rafters 52. Thus, the weight of the roof 54 is supported primarily by the columns 40. Advantageously, the columns 40 are provided in the regions of the walls that have the highest stress concentration.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A plurality of log supports for supporting wooden logs in a generally vertical stack of generally horizontal logs, each of said log supports comprising:

a generally vertical elongated support element having sufficient longitudinal compression strength to support a significant portion of the weight of a log structure and transmit said portion of said weight down through a vertical stack of said log supports to a fixed lower support surface; and a separately formed generally horizontal support element positioned at an end of said vertical support element, said horizontal support element extending beyond the width of said vertical support element, said horizontal support element configured to be selectively engaged and disengaged with said vertical support element;

wherein said log supports are adapted to be vertically stacked to form a generally vertical support column acting on the stack of logs, said log supports adapted to associate suitably with one another so that vertical compression loads are reliably transmitted through said support column, each log support adapted to vertically extend through the width of one or more logs within the stack of logs so that a top end of the vertical support element of the log support is generally aligned with a top surface of a log and a bottom end of the vertical support element of the log support is generally aligned with a bottom surface of a log, the logs through which each log support extends defining a sub-stack of logs, an initial position range of each sub-stack of logs being defined as the space between an initial location of a top surface of a top log of the sub-stack, relative to an initial location of a bottom surface of a lowermost log in the stack of logs, and an initial location of a bottom surface of a bottom log of the sub-stack, relative to the initial location of the bottom surface of the lowermost log in the stack of logs, the horizontal support elements of said log supports being adapted to reside between sub-stacks, said support column adapted to substantially maintain each sub-stack within its initial position range when the logs shrink.

2. The plurality of log supports of claim 1, wherein each log support is configured to extend through only a single log, an initial position range of each log being defined as the space between an initial location of a top surface of the log, relative to the bottom surface of the lowermost log in the stack of logs, and an initial location of a bottom surface of the log, relative to the bottom surface of the lowermost log in the stack of logs, the support column being adapted to substantially maintain each log within its initial position range.

3. The plurality of log supports of claim 1, wherein the horizontal support elements of said log supports are adapted to support the bottom surfaces of the bottom logs of the sub-stacks in the stack of logs and to substantially prevent the bottom surfaces of the bottom logs of the sub-stacks from moving downward, relative to the bottom surface of the lowermost log in the stack of logs.

4. The plurality of log supports of claim 1, wherein the horizontal support elements of said log supports are adapted to support the bottom surfaces of the bottom logs of the sub-stacks in the stack of logs and to maintain a fixed vertical separation between the bottom surfaces of the bottom logs of the sub-stacks.

5. The plurality of log supports of claim 1, wherein the vertical support element of each of said log supports comprises an elongated cylinder, and wherein the horizontal support element of each of said log supports comprises:

a generally flat plate; and a rod attached to a flat side of said plate, an end of said rod being adapted to be slidably and removably inserted into an end of said cylinder.

6. The plurality of log supports of claim 1, wherein the vertical support element of each of said log supports comprises a solid rod.

7. A plurality of log supports for supporting wooden logs in a generally vertical stack of generally horizontal logs, each of said log supports comprising:

a generally vertical elongated support element having sufficient longitudinal compression strength to support a significant portion of the weight of a log structure and transmit said portion of weight down through a vertical stack of said log supports to a fixed lower support surface, said vertical support element having a first end and a second end; and a generally horizontal support element positioned at and being vertically slidably engaged with said first end of said vertical support element, said horizontal support element having sufficient size and strength to support said portion of weight;

said horizontal support element and said second end of said vertical support element sized and shaped such that when said log supports are vertically stacked to form a generally vertical support column the second ends of the vertical support elements of said log supports mate with the horizontal support elements of said log supports so that compression loads are reliably transmitted through said support column.

8. The plurality of log supports of claim 7, wherein said log supports are adapted to be vertically stacked in a plane parallel to or coplanar with a vertical plane through the middle of the stack of logs to form a generally vertical support column acting on the stack of logs, each log support adapted to vertically extend across one or more logs within the stack of logs so that a top end of the vertical support element of the log support is generally aligned with a top surface of a log and a bottom end of the vertical support element of the log support is generally aligned with a bottom surface of a log, the logs across which each log support extends defining a sub-stack of logs, an initial position range of each sub-stack of logs being defined as the space between an initial location of a top surface of a top log of the sub-stack and an initial location of a bottom surface of a bottom log of the sub-stack, the horizontal support elements of said log supports adapted to support bottom surfaces of the bottom logs of the sub-stacks, whereby said log supports are adapted to substantially maintain each sub-stack within its initial position range as the logs shrink.

9. A generally vertical support column for supporting logs in a wall of generally horizontal wooden logs stacked upon a fixed support surface, comprising a plurality of vertically stacked log supports adapted to extend from the fixed support surface, substantially all of said log supports resting upon an upper surface of another of said log supports without being secured to said upper surface, wherein each of said log supports is adapted to provide support to a sub-stack of logs within the wall, each sub-stack being defined as one or more contiguous logs within the wall, an initial position range of each sub-stack being defined as the space between an initial location of the top surface of a top log of the sub-stack and an initial location of the bottom surface of a bottom log of the sub-stack, said log supports being adapted to maintain each sub-stack within its initial position range as the logs shrink.

10. The support column of claim 9, wherein said log supports are adapted to provide support to the bottom surfaces of the bottom logs of the sub-stacks and to prevent the bottom surfaces of the bottom logs of the sub-stacks from moving downward.

11. The support column of claim 9, wherein said log supports are adapted to maintain a fixed separation between the bottom surfaces of the bottom logs of the sub-stacks.

12. The support column of claim 9, wherein an initial position range of each log is defined as the space between an initial location of a top surface of the log and an initial location of a bottom surface of the log, said log supports being adapted to maintain each log in the wall within its initial position range.

13. A log wall comprising:

a stack of generally horizontal wooden logs, a sub-stack of logs being defined as a contiguous set of one or more logs within said stack of logs; and a plurality of support members, each support member comprising a generally vertical support element and a separately formed generally horizontal support element having a generally horizontal surface in contact with and supporting at least the bottom log of a sub-stack of logs, said vertical support element being cut from stock material to determine a length of said vertical support element during assembly of said stack of logs, so that a vertical position of said horizontal support element with respect to a bottom end of said vertical support element can be selected by selection of the length of said vertical support element, wherein said sub-stack of logs does not include the lowermost log in said stack of logs, said support members substantially preventing the bottom log of said sub-stack of logs from moving downward relative to the bottom surface of the lowermost log in said stack of logs as said logs shrink.

14. A plurality of log supports for supporting wooden logs in a generally vertical stack of generally horizontal logs, each of said log supports comprising:

a generally vertical elongated support element having sufficient longitudinal compression strength to support a significant portion of the weight of a log structure and transmit said portion of said weight down through a vertical stack of said log supports to a fixed lower support surface; and a generally horizontal support element positioned at an end of said vertical support element, said horizontal support element extending beyond the width of said vertical support element;

wherein said log supports are adapted to be vertically stacked to form a generally vertical support column acting on the stack of logs, said log supports adapted to associate suitably with one another so that vertical compression loads are reliably transmitted through said support column, each log support adapted to vertically extend through the width of one or more logs within the stack of logs so that a top end of the vertical support element of the log support is generally aligned with a top surface of a log and a bottom end of the vertical support element of the log support is generally aligned with a bottom surface of a log, the logs through which each log support extends defining a sub-stack of logs, an initial position range of each sub-stack of logs being defined as the space between an initial location of a top surface of a top log of the sub-stack, relative to an initial location of a bottom surface of a lowermost log in the stack of logs, and an initial location of a bottom surface of a bottom log of the sub-stack, relative to the initial location of the bottom surface of the lowermost log in the stack of logs, the horizontal support elements of said log supports being adapted --to reside between sub-stacks, said support column adapted to substantially maintain each sub-stack within its initial position range when the logs shrink;

wherein each log support is configured to extend through only a single log, an initial position range of each log being defined as the space between an initial location of a top surface of the log, relative to the bottom surface of the lowermost log in the stack of logs, and an initial location of a bottom surface of the log, relative to the bottom surface of the lowermost log in the stack of logs, the support column being adapted to substantially maintain each log within its initial position range.

15. A plurality of log supports for supporting wooden logs in a generally vertical stack of generally horizontal logs, each of said log supports comprising:

a generally vertical elongated support element having sufficient longitudinal compression strength to support a significant portion of the weight of a log structure and transmit said portion of said weight down through a vertical stack of said log supports to a fixed lower support surface, the vertical support element comprising an elongated cylinder; and a generally horizontal support element positioned at an end of said vertical support element, said horizontal support element extending beyond the width of said vertical support element, the horizontal support element comprising:

a generally flat plate; and a rod attached to a flat side of said plate, an end of said rod being adapted to be slidably and removably inserted into an end of said cylinder;

wherein said log supports are adapted to be vertically stacked to form a generally vertical support column acting on the stack of logs, said log supports adapted to associate suitably with one another so that vertical compression loads are reliably transmitted through said support column, each log support adapted to vertically extend through the width of one or more logs within the stack of logs so that a top end of the vertical support element of the log support is generally aligned with a top surface of a log and a bottom end of the vertical support element of the log support is generally aligned with a bottom surface of a log, the logs through which each log support extends defining a sub-stack of logs, an initial position range of each sub-stack of logs being defined as the space between an initial location of a top surface of a top log of the sub-stack, relative to an initial location of a bottom surface of a lowermost log in the stack of logs, and an initial location of a bottom surface of a bottom log of the sub-stack, relative to the initial location of the bottom surface of the lowermost log in the stack of logs, the horizontal support elements of said log supports being adapted to reside between sub-stacks, said support column adapted to substantially maintain each sub-stack within its initial position range when the logs shrink.

16. A log wall comprising:

a stack of generally horizontal logs, said stack of logs having a vertical channel; and a support column positioned within said vertical channel, said support column comprising a vertical stack of weight-bearing supports, each of said supports comprising:

a generally vertical support element; and a generally horizontal plate positioned on an upper end of said support element, said horizontal plate configured to be selectively engaged and disengaged with said vertical support element;

wherein each of said logs has a top surface in generally horizontal alignment with an upper end of a corresponding support within said column and a bottom surface in a generally horizontal alignment with a lower end of said corresponding support, all of said logs, except for the lowermost log in said stack of logs, resting upon a plate element of a support corresponding to an adjacently lower log, so that said bottom surfaces of said logs are substantially prevented from moving downward due to log shrinkage.

17. A log wall comprising:

a stack of generally horizontally positioned wooden logs, said stack of logs having one or more vertical channels; and one or more support columns each positioned within one of said vertical channels, each of said support columns comprising a vertical stack of weight-bearing supports, each of said supports comprising:

a generally vertical support element; and a separately formed generally horizontal plate element positioned on an end of said support element, said plate element being vertically slidably engaged with said support element;

wherein each of said columns includes one support for each log in said stack of logs, said plate elements retaining their vertical position over time, all of said logs above a lowermost log in said wall resting upon one or more of said plate elements so that the bottom surfaces of said logs are substantially prevented from moving downward, relative to a bottom surface of said lowermost log, as said logs shrink.

18. A log wall comprising:

a stack of generally horizontally oriented logs on a fixed surface; and one or more generally vertical columns acting upon said stack of logs, each column comprising a stack of generally vertical log supports, each stack of log supports extending from said fixed surface and being in a plane parallel to or coplanar with a vertical plane through the middle of said stack of logs, substantially all of the log supports in each column resting upon an upper surface of another of said log supports without being secured to said upper surface;

wherein each of said log supports vertically extends across one or more logs within said stack of logs so that a top end of the log support is generally aligned with a top surface of a log and a bottom end of the log support is generally aligned with a bottom surface of a log, the logs across which each log support extends defining a sub-stack of logs, an initial position range of each sub-stack of logs being defined as the space between an initial location of a top surface of a top log of the sub-stack and an initial location of a bottom surface of a bottom log of the sub-stack, said columns maintaining each sub-stack within its initial position range as said logs shrink.

19. A method for supporting a wall of generally horizontally stacked wooden logs, comprising the steps of:

providing a generally vertical wall of generally horizontally oriented wooden logs on a fixed surface, an initial position range of a contiguous set of one or more logs in said wall being defined as the space between the initial location of the top surface of a top log in the log set and the initial location of the bottom surface of a bottom log in the log set; and maintaining a contiguous set of one or more logs, which does not include the lowermost log in the wall, within its initial position range as the width of said logs in said wall shrink, by supporting a bottom surface of a lowermost log of said contiguous set with one of a plurality of log supports, each of said log supports comprising a vertical support element and a separately formed horizontal support element that is slidably engaged with said vertical support element, said lowermost log of said contiguous set being supported on said horizontal support element.

* * * * *